US006363548B1

(12) United States Patent
Kuo

(10) Patent No.: US 6,363,548 B1
(45) Date of Patent: Apr. 2, 2002

(54) TEMPERATURE-CONTROLLER EQUIPPED FOOT-BATHING DEVICE

(76) Inventor: Tian-Shiang Kuo, 1Fl., No. 14, Lane 208, Sec. 3, Chengde Rd., Taipei City (TW)

( * ) Notice: Subject to any disclaimer, the term of this patent is extended or adjusted under 35 U.S.C. 154(b) by 0 days.

(21) Appl. No.: 09/778,968

(22) Filed: Feb. 9, 2001

(51) Int. Cl.[7] ..... A47K 3/022

(52) U.S. Cl. ..... 4/622; 4/541.4; 4/541.1; 601/156; 601/157

(58) Field of Search ..... 4/622, 619, 541.1, 4/541.2, 541.3, 541.4, 541.5, 545, 452; 601/156, 157

(56) References Cited

U.S. PATENT DOCUMENTS 3,027,568 A * 4/1962 Blau et al. ..... 4/615
3,380,080 A * 4/1968 Farrell ..... 4/622
3,571,818 A * 3/1971 Jacuzzi ..... 4/180
3,965,495 A * 6/1976 McNair ..... 4/182
4,047,522 A * 9/1977 Plugge ..... 128/66
4,485,503 A * 12/1984 Rolando et al. ..... 4/622
4,497,313 A * 2/1985 Kurosawa ..... 601/16
4,620,529 A * 11/1986 Kurosawa ..... 601/157
4,924,069 A * 5/1990 Giordani ..... 219/306

* cited by examiner

*Primary Examiner*—Robert M. Fetsuga
*Assistant Examiner*—Huyen Le
(74) *Attorney, Agent, or Firm*—Raymond Y. Chan; David & Raymond Patent Group

(57) ABSTRACT

A temperature-controller equipped foot-bathing device mainly comprises a basin, a heating device, a temperature-control device, a water pump, and an air-feeding device, wherein the heating device is disposed in a lower part of the basin for heating the loaded liquid. A user may control the liquid temperature externally to associate with air feeding and adjustment for the medicine blended liquid to seep through foot sole skin. Moreover, a dual-security mechanism of this invention is offered for protecting the user.

6 Claims, 7 Drawing Sheets

TEMPERATURE-CONTROLLER EQUIPPED FOOT-BATHING DEVICE

BACKGROUND OF THE INVENTION

1. Field of the Invention

This invention relates generally to foot-bathing appliance, particularly to a temperature-controller equipped foot-bathing device that enables a user to enjoy the foot-bathing pleasure comfortably and safely.

2. Description of the Prior Art

A generic foot-bathing device so far is vibrated to agitate a liquid in basin to dissolve medicines for foot bathing. However, it is rare to find a foot-bathing device provided with a heating element in the market, maybe because the makers are in worry of the electric heating manner that can probably incur an accident due to user's carelessness or poor design of the bathing device. Some of the foot-bathing device fitted with heating element are offered with a fuse apiece to turn off power in time so as to ensure security in the case of a short circuit, which, the fuse, is considered not good enough for prevention of accidents.

In view of abovesaid imperfection, after years of constant effort in research, the inventor of this invention has consequently developed an improved mechanism pertaining to the subject matter to be described below.

SUMMARY OF THE INVENTION

The primary object of this invention is to provide a temperature-controller equipped foot-bathing device that uses water flow to dissolve medicine in basin for circulating medical effect.

Another object of this invention is to provide a temperature-controller equipped foot-bathing device with a specially packaged heating device and controllable heating manner to ensure security.

Yet another object of this invention is to provide a temperature-controller equipped foot-bathing device that can suck air into water to increase oxygen content and expel anaerobic bacteria to promote breath of human sole skin.

A furthermore object of this invention is to provide a temperature-controller equipped foot-bathing device, which is fitted with a temperature-control device to enable a user to externally control temperature of liquid in a dipping basin.

In order to realize abovesaid objects, the temperature-controller equipped foot-bathing device of this invention comprises a basin, a heating device, a water pump, an air-feeding device, and an electronic control device.

The basin is substantially a hollow vessel for loading and circulating a liquid, in which a space is available for accommodating a user's feet.

The heating device is controlled by a microprocessor for heating intermittently according to a timing clock and is composed of an electrically nonconductive quartz tube entangled with a heating element, which is fixed uniformly with Magnesium oxide powder before being shielded with Mica cloth on its outmost layer. The heating element is thus separated from the liquid flowing in the quartz tube, and the heat generated from the heating element is well insulated for protecting components and avoiding malfunctions.

The water pump mainly comprises a submerged motor of bipolar magnetic core and a fan leaf mounted on a shaft thereof. When the submerged motor operates, the fan leaf is driven to extract the liquid upwardly to thereby enable the liquid to cycle repeatedly.

The air-feeding device includes a tapered air duct, which penetrates the basin connect with an intake duct extended from a gas intake. A spiral swivel for regulating airflow is provided to the air duct and locked at the basin, wherein a reverse conical body is disposed underneath the spiral swivel. When the spiral swivel is turned downwards, the conical body will descend to choke the air duct to close the air channel and vice versa.

The electronic control device of this invention comprises a single chip microprocessor, a key-in device, a display-driving circuit, a display device, a motor-control circuit, the motor, a heating-control circuit, a power supply, a voltage regulator, and a temperature-control device. And, by taking advantage of the control device, a user can directly and externally control liquid temperature to enhance security.

For more detailed information regarding this invention together with advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
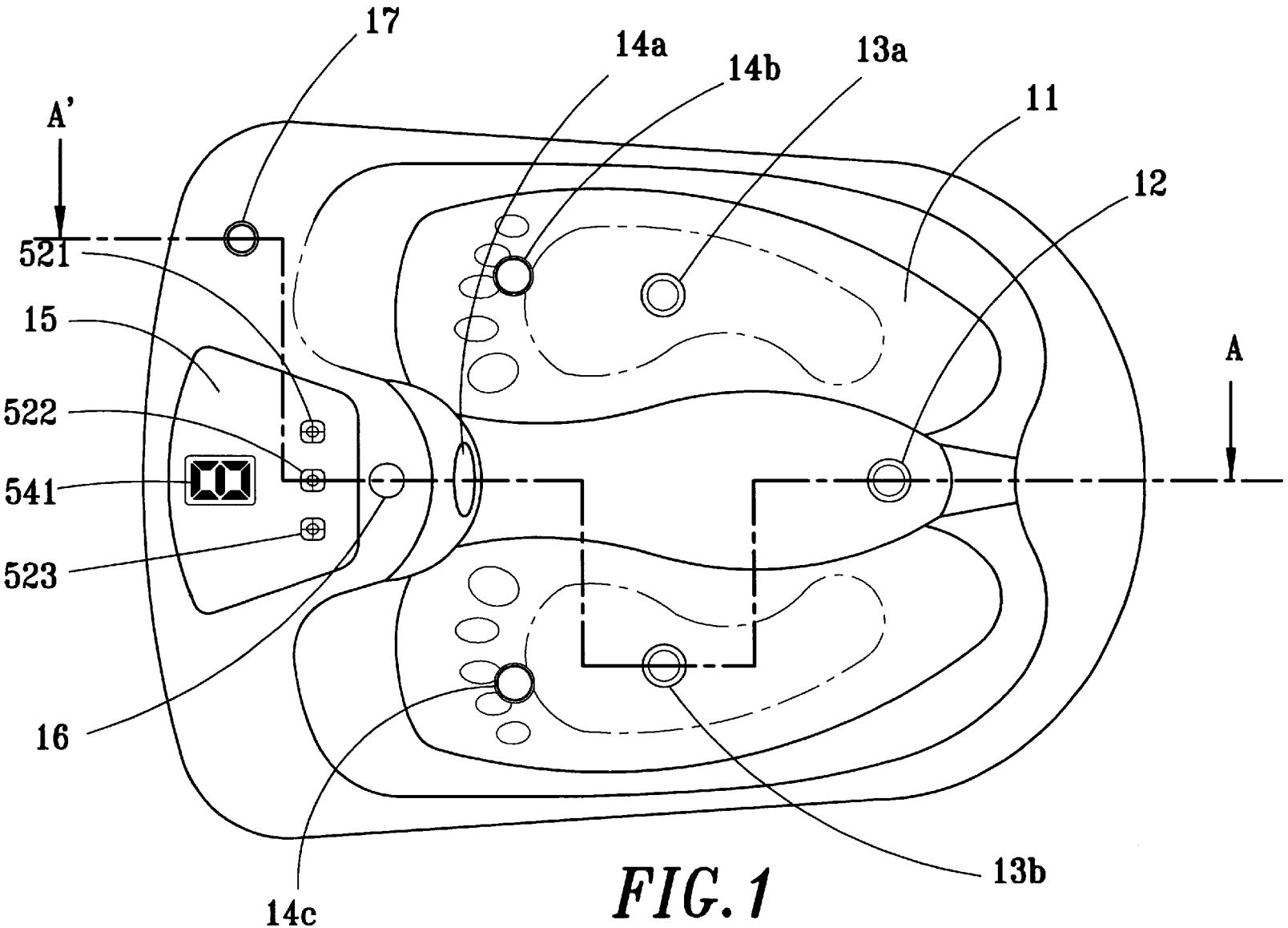
FIG. 1 is a top view of a temperature-controller equipped foot-bathing device of this invention.
Figure 2:
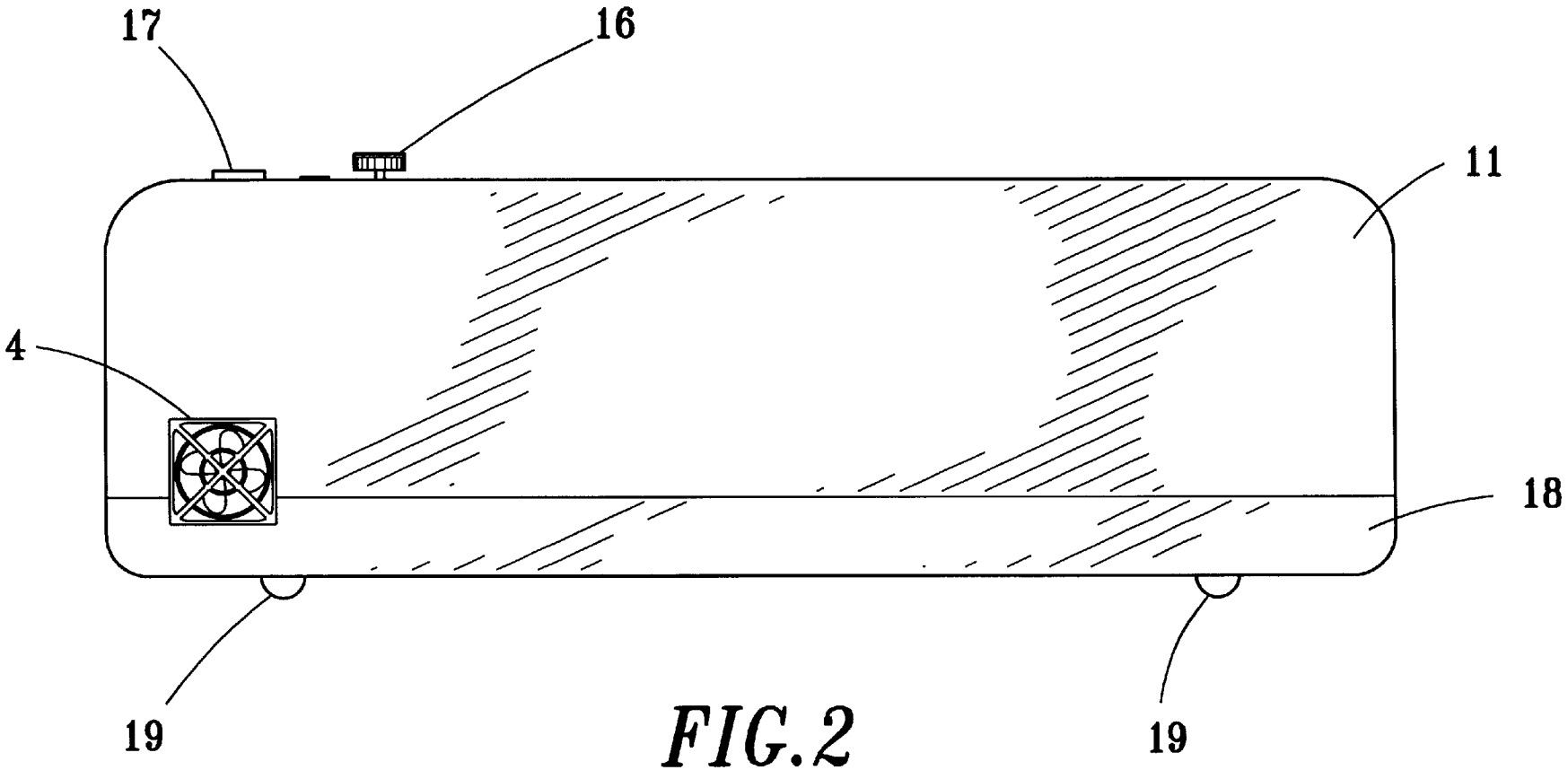
FIG. 2 is a lateral view of the foot-bathing device of this invention.

As illustrated in a top and a lateral view of a temperature-controller equipped foot-bathing device of this invention shown in FIGS. 1 and 2, a basin 11 is an inwardly concave hollow vessel for loading liquid provided with a guiding hole 12, a plurality of water inlets 13*a*, 13*b*, and three water-outlets 14*a*, 14*b*, 14*c*. A liquid is poured into a heating device through the guiding hole 12 to merge with that enters the water inlets 13*a*, 13*b*, then flows into a water pump and an air-feeding device for being pumped to spout from the water outlets 14*a*, 14*b*, 14*c* and build a complete flow cycle, which can thoroughly agitate a dissolved medicine lotion for promoting spontaneous curing effect.

A panel 15 disposed on a foot-bathing device 1 is provided with a 7-seg display 541 and three plain keys, wherein the 7-seg display 541 is applied for showing the heating stage, and the plain keys include a power key 521, a temperature key 522, and a start key 523. Under the panel 15, a spiral swivel 16 is disposed for control of airflow passing through an air intake 17. A lower casing 18 is combined closely with the basin 11 to form an integral basin casing for protecting inside components and for the purpose of beautification and safety.

A fan 4 is arranged between the basin 11 and the lower casing 18 for expelling internal moist air in the foot-bathing device 1 to keep components dry, and a plurality of non-slip pads 19 is attached to the bottom face of the lower casing 18 to prevent the basin 11 from sliding.

The water inlets 13*a*, 13*b* are located at positions to stimulate the YUNG CHUAN acupoints (K–1) of human foot soles continuously for obtaining healing effect by taking advantage of an inward adsorption force of the liquid. Moreover, the water inlets 13*a*, 13*b* are exchangeable with the water outlets 14*a*, 14*b*, 14*c* so that an outward impact force will take place instead of the original inward adsorption force to massage the YUNG CHUAN acupoints. Substantially, the water inlets 13*a*, 13*b* and the water outlets 14*a*, 14*b*, 14*c*can be arranged at positions arbitrarily subject to requirements.

Figure 3:
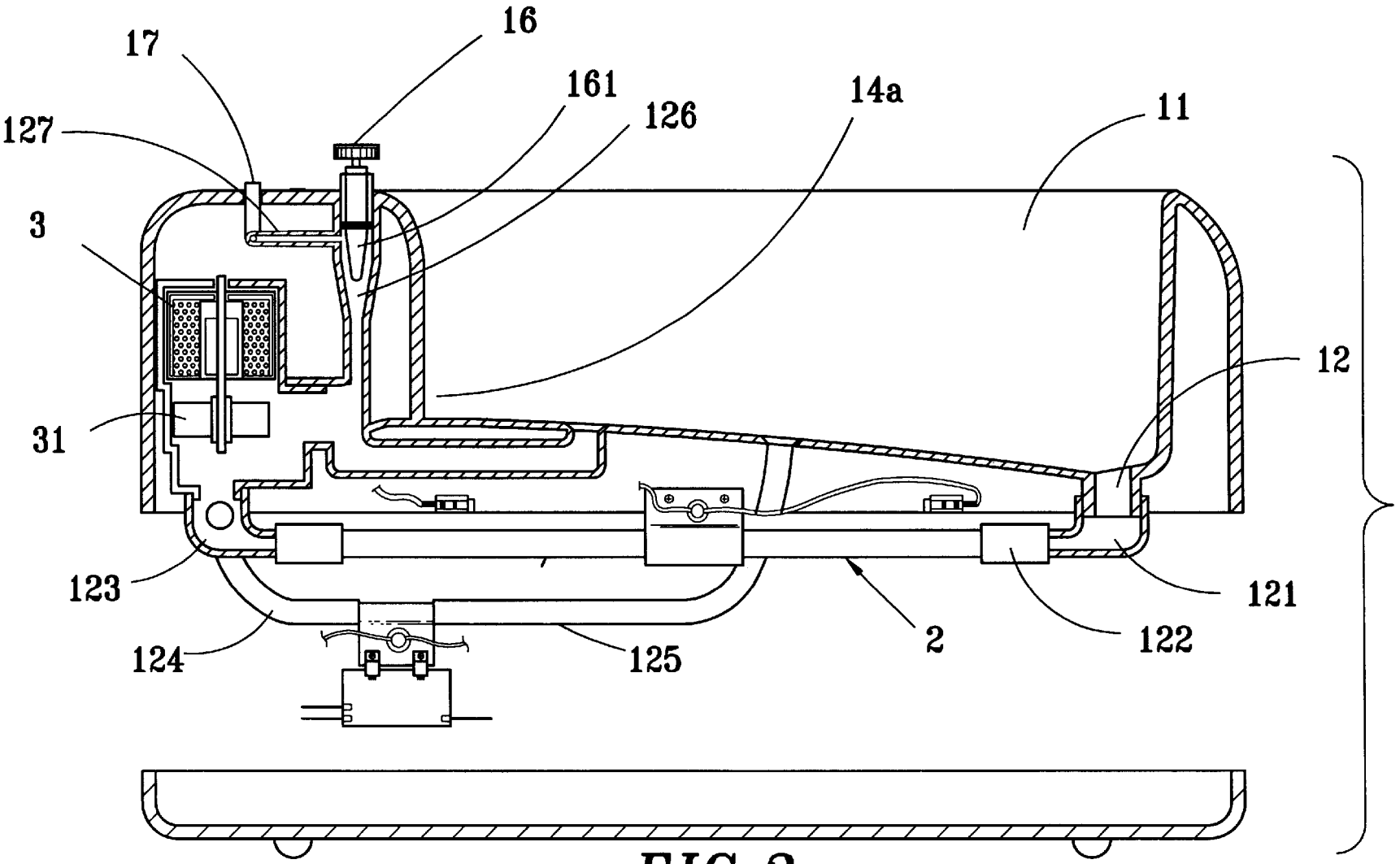
FIG. 3 is a cutaway sectional view of the foot-bathing device of this invention taken along line A–A' shown in FIG. 1.

As indicated in a cutaway sectional view of the foot-bathing device taken along line A–A' of FIG. 1 shown in FIG. 3, this invention mainly comprises the basin 11 as mentioned above, a heating device 2, a water pump, and an air-feeding device.

The heating device 2 is controlled by a microprocessor to heat intermittently basing on a timing clock and is composed of an electrically insulated quartz tube entangled with a heating element, which is fixed uniformly with Magnesium oxide powder before being shielded with Mica cloth on its outmost layer. The heating element is thus separated from the liquid flowing in the quartz tube, and the heat generated from the heating element is well insulated to protect related components for avoiding malfunctions.

The water pump mainly comprises a submerged motor 3 with bipolar magnetic core and a fan leaf 31 mounted on a shaft thereof. When the submerged motor 3 operates, the fan leaf 31 is driven to extract the liquid upwardly to thereby enable the liquid to cycle repeatedly.

The air-feeding device includes a tapered air duct 126, which penetrates the basin 11 connect with an intake duct 127 extended from a gas intake 17. A spiral swivel 16 for regulating airflow is provided to the air duct 126 and locked at the basin 11, wherein a reverse conical body 161 is disposed underneath the spiral swivel 16. When the spiral swivel 16 is turned downwards, the conical body 161 will descend to choke the air duct 126 to close the air channel and vice versa.

The liquid enters the guiding hole 12 and passes through a guide duct 121 to flow into the heating device 2, wherein the guide duct 121 is jointed with the heating device 2 via a rubber plug 122. Then, the motor 3 would drive the fan leaf 31 to have the heated liquid passed through a Y-connector 123 and pumped to go upwardly for blending with input air through the gas intake 17. The bubble-contained liquid then spouts from the water outlets 14*a*, 14*b*, 14*c* in the basin 11.

Figure 4:
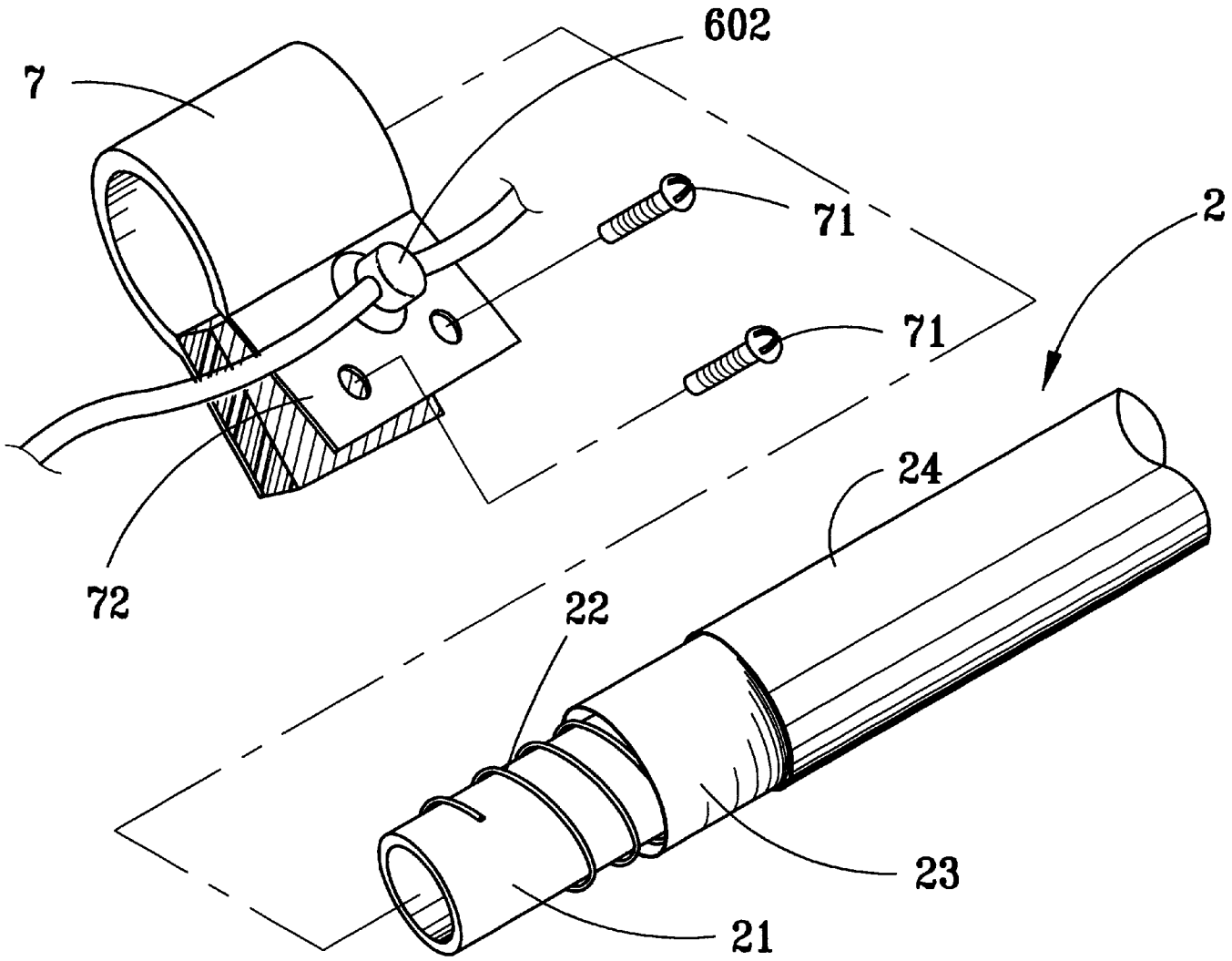
FIG. 4 is an exploded view of a heating device fitted in the foot-bathing device of this invention.

As illustrated in a partially exploded view of a heating device in the foot-bathing device of this invention shown in FIG. 4, the heating device 2 contains a nonconductive quartz tube 21 wound with an electric heating element 22 fixed uniformly by magnesium oxide powder 23 and shielded with Mica cloth 24 on the outmost layer of the quartz tube 21. When the electric heating element 22 is heated, the liquid and the heating element 22 inside or outside the quartz tube 21 are electrically separated, and the Mica cloth can effectively protect components against heat to avoid malfunctions. Besides, a metallic clamp 7 collars and locks on the heating device 2 with a set screw 71, wherein a 120° C.-down resistible temperature-control switch 602 is located on an extension part 72 of the metallic clamp 7 for detecting whether any abnormal temperature exceeding the rated degree occurs maybe because of improper operation or component's breakdown, and cutting off the power supply for security purpose if positive.

Figure 5:
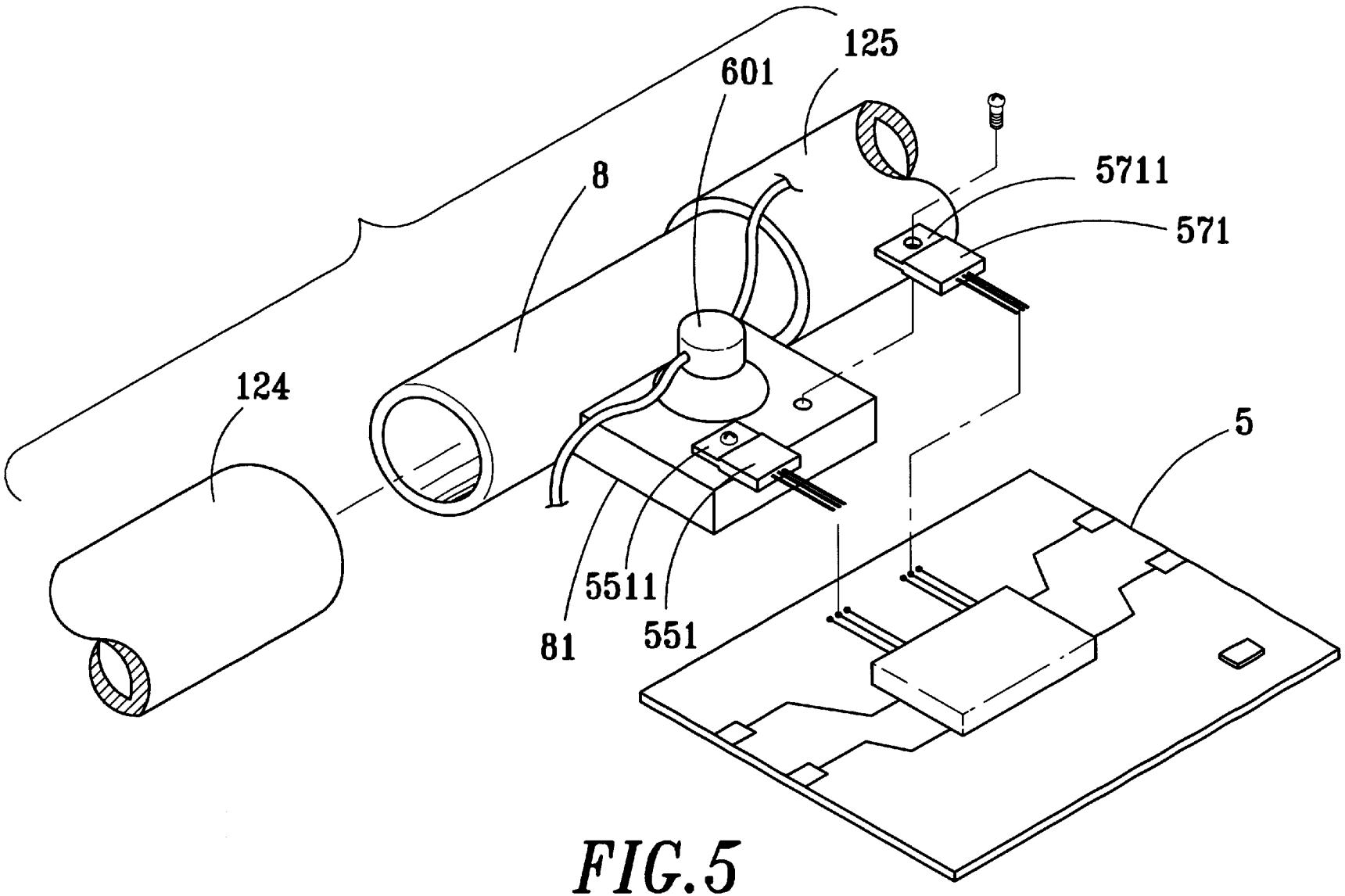
FIG. 5 is a partially enlarged view of a temperature controller fitted in the foot-bathing device of this invention.

In FIG. 5-*a* partially enlarged view of a temperature controller fitted in the foot-bathing device of this invention-a metallic linking pipe 8 is extended laterally to form an extension part 81, wherein one end of the metallic linking pipe 8 is jointed with a guiding duct 124 connected to the Y-connector 123 while the other is jointed with a drainpipe 125 connected to a drain outlet; the extension part 81 further comprises a 50° C.-down resistible temperature-control switch 601 and two pieces of TRIAC 551, 571 for controlling the motor and the heating device; and the TRIACs are coupled to a control PCB (printed circuit board) 5 to serve for a control hub of this invention. When the liquid in the basin is heated, the heated liquid flows through the drainpipe 125 to reach the metallic pipe 8 and conduct heat to the temperature-control switch 601, which will operate to shut off the heating element in case temperature of the liquid rises up to 50° C. A heat sink 5511, 5711 of each TRIAC 551, 571 is locked to the extension part 81 of the metallic linking pipe 8 for heat dissipation.

Figure 6:
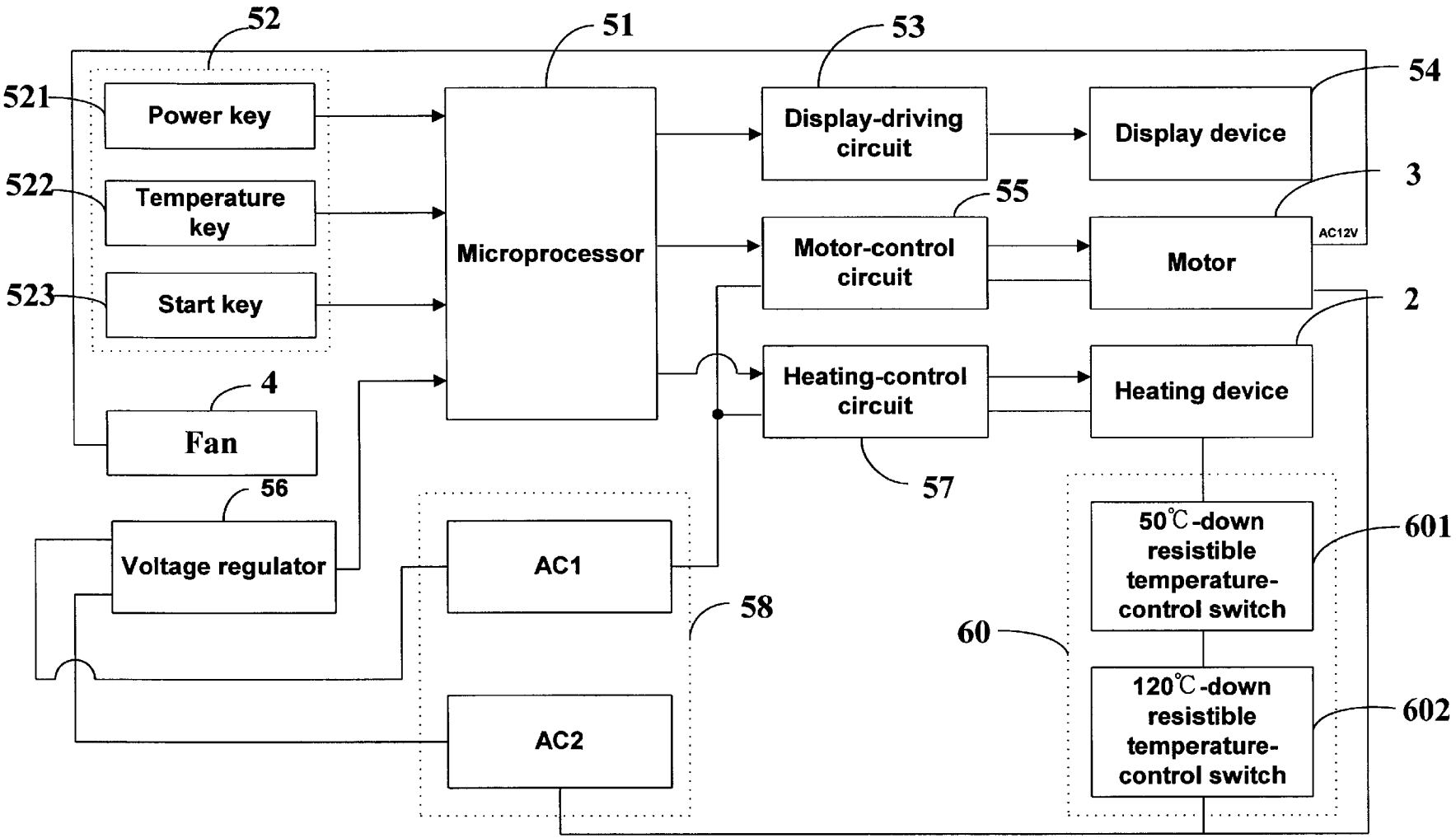
FIG. 6 indicates a circuit block diagram of the foot-bathing device of this invention.
Figure 7:
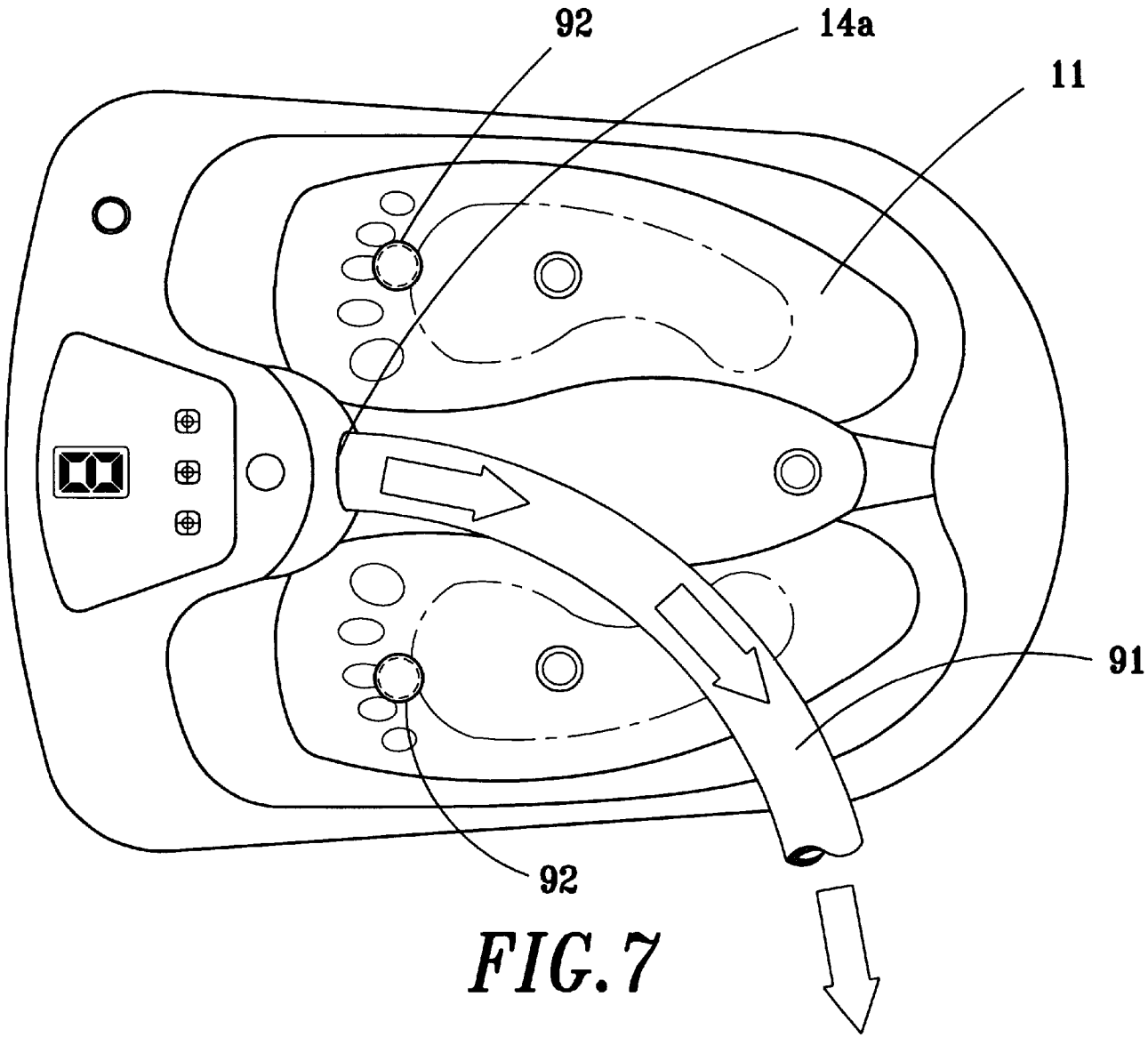
FIG. 7 is a schematic view showing that a drainpipe is installed in the foot-bathing device of this invention.

Referring to a circuit block diagram of this invention shown in FIG. 6, an electronic control device of this invention comprises a single chip microprocessor 51, a key-in device 52, a display-driving circuit 53, a display device 54, a motor-control circuit 55, the motor 3, a heating-control circuit 57, a power supply 58, a voltage regulator 56, and a temperature-control device 60.

The microprocessor 51 is used for dealing with various input signals and convert them into control signals for output to related devices.

The key-in device 52 is composed of those three plain keys, namely, a power key 521, a temperature key 522, and a start key 523, wherein the power key 521 is the main switch of the control device; the temperature key 522 provides a cyclic multistage input (0-1-2- . . . -8-0-1) for presetting so that the heating device 2 will heat and keep at desired temperature according to the preset stages; and the start key 523 is applied to start the motor 3 and the heating device 2 to work after temperature stages have been preset.

The display-driving circuit 53 will forward an output control signal to the display device 54 upon receipt of a signal from the microprocessor 51.

The display device 54 is a 7-seg display for showing the temperature stage.

The motor-control circuit 55 is a control circuit containing a TRIAC. The motor-control circuit 55 is to receive a control signal from the microprocessor 51 so as to effect an output signal to control ON/OFF operation of the motor 3.

The motor 3 is a submerged motor with bipolar magnetic core to be driven by a signal of the motor-control circuit 55, wherein a 12 VAC power source can be obtained from a tap in the secondary coil of the motor 3 and rectified to support a low-voltage DC motor for dehumidifying the fan 4.

The heating-control circuit 57 is a control circuit containing a TRIAC. The heating-control circuit 57 is to receive a control signal from the microprocessor 51 so as to forward an output signal to control ON/OFF operation of the heating device 2.

The power supply 58 is a 110 VAC power source to support the motor 3 and the heating device 2.

The voltage regulator 56 is used to regulate the power supply 58 and provide a 5 VDC power source.

The temperature control device 60 comprises the temperature-control switches 601, 602, which are connected in series, wherein the 50° C.-down resistible temperature-control switch 601 is arranged for preventing the liquid from being overheated while the 120° C.-down resistible temperature-control switch 602 for prevention of improper operation or component's breakdown to thereby provide a dual-security assurance.

After use of this invention, a user is supposed to connect a drainpipe 91 to the water outlet 14*a* in the basin 11 and block the side water outlets 14*b*, 14*c* with a plug 92 respectively for draining the used liquid automatically.

In short, compared with the conventional, the merits of this invention may be summarized as the following:

1. The dissolved medicine can seep through the foot sole in the manner like capillary phenomenon to produce medical effect.

2. A plurality of control switches is applied for upgrading security.

3. Circulating water flow can take away attachments on foot soles to increase contact surface of medicine to the foot soles.

4. The temperature-control device enables a user to externally control the temperature of the inside liquid.

5. The drainpipe is advantageous for draining the used liquid automatically.

In the above described, at least one preferred embodiment has been elucidated with reference to the drawings annexed, and it is apparent that numerous variations or modifications may be made without departing from the true spirit and scope thereof, as set forth in the claims below.

What is claimed is:

1. A temperature-controller equipped foot-bathing device, comprising:

a basin being substantially a hollow vessel for loading and circulating a liquid, in which a space is available for accommodating a pair of user's feet;

a heating device being controlled by a microprocessor for heating intermittently according to a timing clock and composed of an electrically nonconductive quartz tube entangled with a heating element, wherein the heating element is fixed uniformly with Magnesium oxide powder before being shielded with Mica cloth on the outmost layer of the quartz tube; the heating element is thus separated from the liquid flowing in the quartz tube, and the heat generated from the heating element is well insulated for protecting components and avoiding malfunctions;

a water pump further comprising a motor of bipolar magnetic core and a fan leaf mounted on a shaft thereof, wherein the fan leaf is driven to extract the liquid upwardly to thereby enable the liquid to cycle repeatedly when the motor operates;

an air-feeding device including a tapered air duct, which penetrates the basin connect with an intake duct extended from a gas intake, wherein a spiral swivel for regulating airflow is provided to the air duct and locked at the basin; a reverse conical body is disposed underneath the spiral swivel; and the conical body will descend to choke the air duct to close the air channel when the spiral swivel is turned downwards and vice versa; and an electronic control device, which enables a user to directly and externally control the liquid temperature, and by taking advantage of difference in temperature resistible of two temperature-control switches, a double-security mechanism is erected;

wherein the liquid flows through a guiding hole into the heating device for being heated, then the motor would drive the fan leaf to have the heated liquid passed through a Y-connector and pumped to go upwardly for blending with input air through the gas intake, and the bubble-contained liquid then spouts from three water outlets in the basin.

2. The foot-bathing device according to claim 1, wherein the electronic control device further comprises:

a microprocessor used for dealing with a variety of input signals and converting them into control signals for output to related devices;

a key-in device composed of three plain keys, namely, a power key, a temperature key, and a start key, wherein the power key is the main switch of the control device; the temperature key provides a cyclic multistage input (0-1-2- . . . -8-0-1) for presetting so that the heating device will heat and keep at desired temperature according to the preset stages; and the start key is applied to start the motor and the heating device to work after temperature stages have been preset;

a display-driving circuit for forwarding an output control signal to a display device upon receipt of a signal from the microprocessor;

the display device being a 7-seg display for showing the temperature stage;

a motor-control circuit being a control circuit containing a TRIAC for receiving a control signal from the microprocessor so as to effect an output signal to control ON/OFF operation of the motor;

a heating-control circuit being a control circuit containing a TRIAC for receiving a control signal from the microprocessor so as to forward an output signal to control ON/OFF operation of the heating device;

a power supply being a 110 VAC power source for supporting the motor and the heating device;

a voltage regulator applied to regulate the power supply and provide a 5 VDC power source; and a temperature control device comprising the temperature-control switches, which are connected in series, wherein the 50° C.-down resistible temperature-control switch is arranged for preventing the liquid from being overheated while the 120° C.-down resistible temperature-control switch for prevention of improper operation or component's breakdown so as to provide a dual-security assurance.

3. The foot-bathing device according to claim 2, wherein a heat sink on top of the TRIAC is locked at extension part of a metallic linking pipe to take advantage of liquid flow for realizing effect of heat dissipation.

4. The foot-bathing device according to claim 1, wherein the motor is a submerged motor with bipolar magnetic core to be driven by a signal of the motor-control circuit, wherein a large current AC power source can be obtained from a tap in the secondary coil of the motor and rectified to support a low-voltage DC motor applied in a fan for dehumidification.

5. The foot-bathing device according to claim 1, wherein one of those three water outlets is jointed with a drainpipe for draining used liquid after bathing.

6. The foot-bathing device according to claim 1, wherein a plurality of water inlets and outlets is disposed in the basin at proper positions.

* * * * *